United States Patent [19]

Jung

[11] 4,441,444

[45] Apr. 10, 1984

[54] ANTI-FRICTION APPARATUS FOR CLOTH FEEDPLATE

[75] Inventor: Wilhelm H. Jung, Mechanicsville, Va.

[73] Assignee: AMF Inc., White Plains, N.Y.

[21] Appl. No.: 352,819

[22] Filed: Feb. 26, 1982

[51] Int. Cl.³ ..... D05B 3/04

[52] U.S. Cl. ..... 112/311; 112/163; 112/260

[58] Field of Search ..... 112/76, 163, 260, 311, 112/70; 271/264

[56] References Cited

U.S. PATENT DOCUMENTS

| | | | |
|---|---|---|---|
| 2,767,982 | 10/1956 | Noon | 271/251 |
| 2,837,047 | 6/1958 | Sheppard | 112/260 |
| 3,896,748 | 7/1975 | Kostenowczyk | 112/70 |
| 4,221,181 | 9/1980 | Totino | 112/311 |

*Primary Examiner*—Werner H. Schroeder
*Assistant Examiner*—Andrew M. Falik
*Attorney, Agent, or Firm*—David E. Dougherty

[57] ABSTRACT

A throat plate of a sewing machine with a feed plate is provided with disc type bearings retained in fixed position adjacent to the needle hole of the throat plate to support and provide low friction surfaces in contact with the feed plate.

8 Claims, 4 Drawing Figures

ANTI-FRICTION APPARATUS FOR CLOTH FEEDPLATE

This invention relates generally to sewing machines and particularly to such machines which incorporate feedplates.

In many specialized industrial sewing machines, cloth feedplates are provided in lieu of toothed feed dogs for moving the cloth past the needles. While such feedplates are used with single needle machines, they are particularly adapted for use in twin needle tackers of the type disclosed in my U.S. Pat. Nos. 4,043,283 and 4,256,048, which are made part of the disclosure by reference herein. When embodying a feedplate, the cloth is clamped to the plate which is programmed to move in a particular pattern on the bed or sewing table of the machine. It is common to connect the drive means to the inner end of the feedplate as shown in the aforenoted patents.

It should be readily seen that there is a substantial interface creating surface friction and wear between the throatplate and moving feedplate which result in additional stresses on the feedplate drive means and can limit the speed of sewing. The surface friction or drag and wear of course increases with the size of the feedplate. Traditionally, throatplates have been made of case hardened or hard chrome plated steel as are cloth feedplates. The surfaces forming the interface have been polished and nylon tape has been applied to the surface of the feedplate to reduce friction and wear with only limited success. Other attempts to reduce such friction and wear are not new. As shown in U.S. Pat. No. 3,159,125 issued Dec. 1, 1964 to R. J. H. Vandewouwer, oil is provided in perforations of a fixed feedplate which is applied thereby to the under side of the material being sewn. This solution which may be suitable for some applications would be intolerable for stitching fabric for clothing. U.S. Pat. No. 4,221,181 issued Sept. 9, 1980 to Totino teaches the use of ball bearings in tracks between a throatplate and a small feedplate beneath a top feed dog. This arrangement permits only a single stitching pattern which, if changed, requires changing the throatplate with the feedplate movably connected thereto.

Accordingly, an object of the present invention is to provide a sewing machine with anti-friction means between a cloth feedplate and the throatplate of a sewing table.

Another object of the present invention is to provide the foregoing anti-friction means which does not limit the programmed universal movement of the feedplate.

And, another object of the present invention is to provide the foregoing anti-friction means devoid of any material which would be harmful or deleterious to the material being sewn.

Still, another object of the present invention is to provide the foregoing anti-friction means which can be replaced with facility.

The foregoing and other objects and advantages will appear more fully hereinafter from a consideration of the detailed description which follows, taken together with the accompanying drawings wherein a single embodiment of the invention is illustrated by way of example. It is to be expressly understood, however, that the drawings are for illustration purposes only and are not to be construed as defining the limits of the invention.

Figure 1:
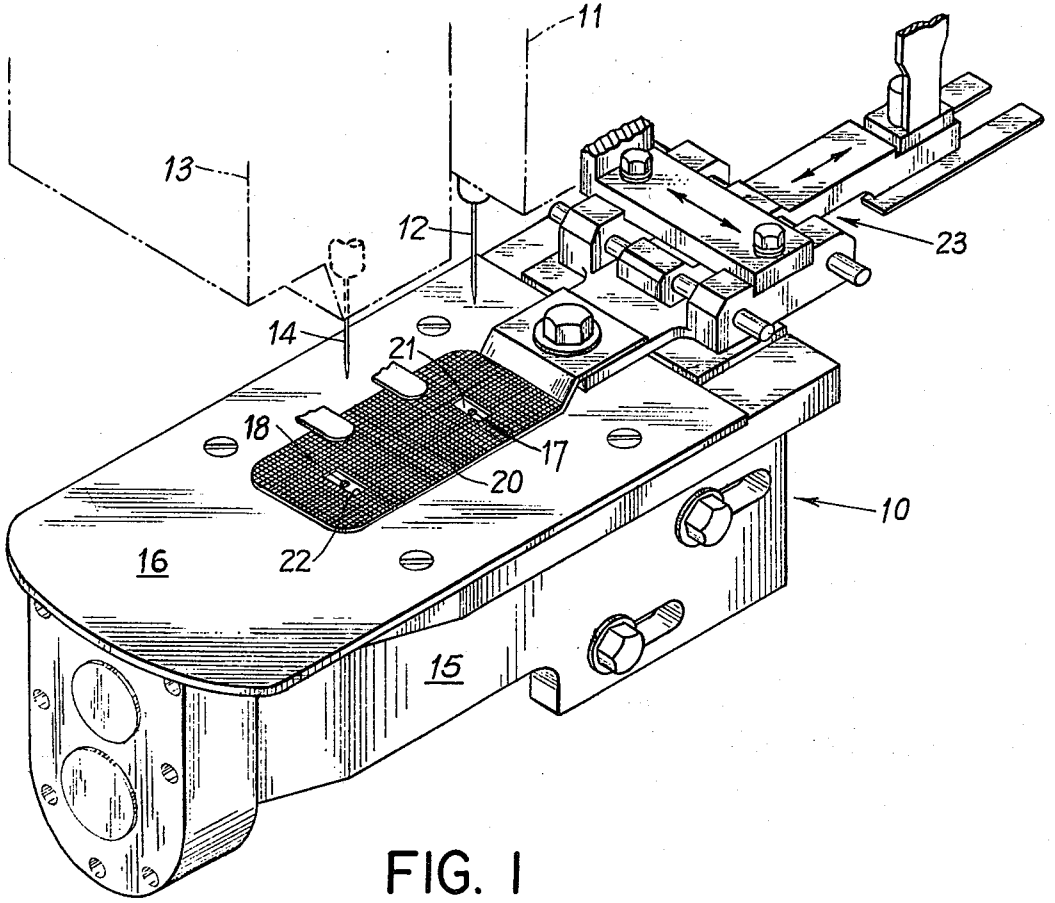
FIG. 1 is a perspective view of the working end of a twin needle sewing machine providing utility for the present invention.

Referring now to the drawings, a sewing machine 10, shown in part, is provided with a fixed head 11 having a mechanism for reciprocally driving a needle 12, and with an adjustable head 13 having a mechanism for reciprocally driving a needle 14 in unison with the needle 12. The sewing machine 10 also has a frame or bed 15 enclosing a pair of bobbins and the usual mechanism associated therewith as disclosed by my aforenoted patents. A throatplate 16 is mounted on the bed or frame 15 and is provided with a spaced pair of holes 17 and 18 appropriately aligned for the needles 12 and 14. The heads 11 and 13 and the needles 12 and 14 together with the bed 15 and throatplate 16 form the sewing station of the machine 10 which, in this instance, is a twin needle tacker.

In lieu of toothed feed dogs normally embodied in a sewing machine, the machine 10 is provided with a cloth feed plate 20 having clamp means for holding the cloth to be stitched and drive means 23 connected to universally drive plate 20 in a preprogrammed pattern in response to lateral and longitudinal input movement. The feedplate 20 is provided with a spaced pair of slots or openings 21 and 22 appropriately aligned and being of a required size and shape to expose the needle holes 17 and 18 at all times regardless of the position of the feedplate 20 during its movement in its predetermined pattern.

Up to this time, a feedplate 20 was supported on a throatplate 16 forming an interface having a substantial amount of contact or surface friction which tended to cause wear, retard movement of the feedplate and, in turn, the stitching rate of the machine 10 which is interlocked with movement of the feedplate. In accordance with the present invention, a plurality of anti-friction or bearing means 25 are provided around each of the needle holes 17 and 18 as shown in FIG. 2 and sufficiently spaced from the needle hole so they are never even partly exposed by the openings 21 and 22 during the movement of the cloth feedplate 20.

Figure 4:
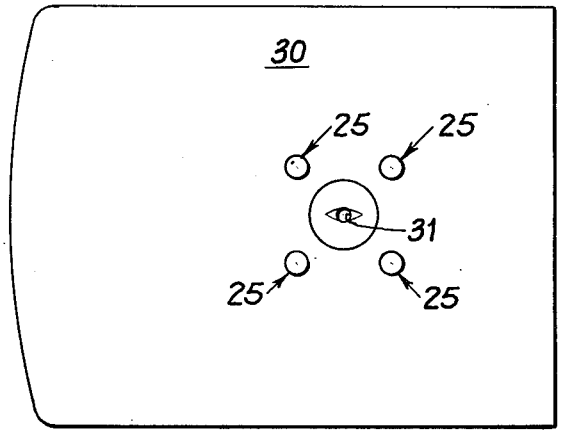
FIG. 4 is a plan view similar to FIG. 2 illustrating the invention used with a single needle machine.

Referring now to FIG. 4, a throatplate 30 is provided with four anti-friction or bearing members 25 in an equally spaced series spaced outwardly and around the single needle hole 31. To provide a balanced support acting against possible tipping of a feedplate, not shown, two of the bearings 25 are forward of the needle hole 31 and two are aft thereof. Also, one bearing of the pair forward of the needle hole is disposed on each side of the needle hole, and the pair of bearings aft of the needle hole is similarly disposed.

Figure 2:
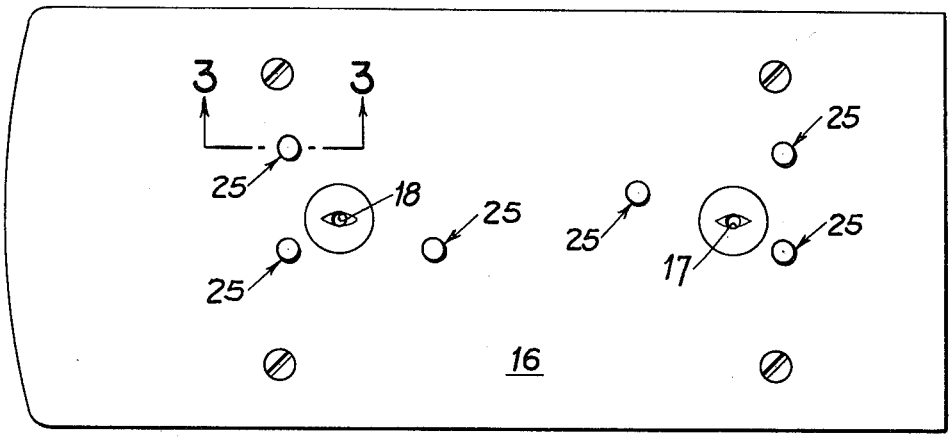
FIG. 2 is an enlarged plan view of the throatplate of the machine of FIG. 1 which embodies the present invention.

Reverting back to FIG. 2, the twin needle throatplate 16 is provided with a spaced pair of bearings or anti-friction means 25 outboard from each of the needle holes 17 and 18, with one bearing means of each pair being forward of a needle hole and the other being aft thereof. Inboard or between the two needle holes, one anti-friction means is spaced from and forward of one of the needle holes while another anti-friction means is spaced from and aft of the other needle hole.

The bearings or anti-friction means 25 have better wear characteristics and a lower coefficient of friction than steel throat and feedplates 16 and 20, and are preferably of a plastic such as nylon, FEP Teflon made by DuPont, polyformaldehydes such as DuPont Delrin and Celanese Celcon, and an ultra-high molecular weight polyethylene such as Hercules 1900. The foregoing are provided merely as examples and are not to be construed as defining limitations of the present invention. The bearings in addition to having better wear characteristics and a lower coefficient of surface friction than the throatplate 16 or feedplate 20, form interfaces with the feedplate which together have an area which is a small fraction of the interspace between such plates or the normal contact area of such plates when such bearings are not provided.

Discs of such bearing material are inserted into appropriately located recesses in the top surface of a throatplate and extended outwardly therefrom engaging the bottom surface of a feedplate with the top surfaces of the discs thereby removing the interface and providing a space in the range of 0.005 to 0.010 inch between the adjacent surfaces. By use of such bearings the frictional coefficients were reduced and the frictional interface subject to wear was dramatically reduced.

Figure 3:
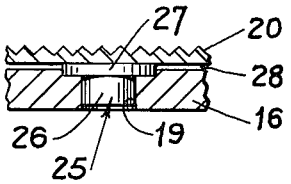
FIG. 3 is an enlarged fragmentary sectional view of the throatplate taken on line 3—3 of FIG. 2 with corresponding portion of a cloth plate.

While the desired results were realized, it was noted that vibration tended to dislodge newly inserted or unused disc type bearings which became difficult to replace when worn. As an improvement and a preferred arrangement is to provide throatplate 16 with countersunk or stepped through bores 19 as shown in FIG. 3 in lieu of the aforementioned surface recesses. The bearings 25 are now made in the form of a plug having a stem portion 26 extending from an enlarged disc type head 27. The stem 26 is pressed into the bore 19 to retain the head 27 appropriately positioned and extending outwardly of the throatplate 16 to engage the feedplate 20 and provide the limited interspace 28 as shown. The top surface of each bearing 25 is preferably flat or provided with a shallow crown. When this type of bearing is to be replaced, the worn bearing 25 can be pushed out of the through bore 19.

Although but a single embodiment of the invention has been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. In a sewing machine having a throatplate with a needle hole and a feedplate disposed above said throatplate universally driven in accordance with a preprogrammed pattern and having an opening continuously exposing the needle hole, the improvement comprising an anti-friction means comprising a plurality of openings in said throat plate in a spaced series around said needle hole;

a plurality of bearing and support means each disposed in close fitting relationship in a different one of said openings and extending outwardly therefrom engaging said feed plate from beneath to support same at a fixed distance above the throatplate and to provide a low friction connection beneath the throatplate and the feedplate;

said bearing means being of a better wear resistant material having a lower coefficient of friction than said throat and feedplates.

2. The anti-friction means in accordance with claim 1, wherein said bearing means forming interfaces with said feedplate equal in area to only a small fraction of the interspace between said throat and feedplates.

3. The improvement in a sewing machine in accordance with claim 2, said bearing and support means each comprising a disc disposed in a different one of said openings in said throatplate and extending outwardly therefrom engaging said feedplate.

4. The anti-friction means in accordance with claim 3, wherein each of said openings is a through bore with an enlarged end portion adjacent said feedplate; and said disc disposed in said enlarged portion and having a stem extending therefrom further into said opening.

5. The anti-friction means in accordance with claim 4, wherein the bottom of each opening provides access for pushing a worn bearing therefrom.

6. The improvement in a sewing machine in accordance with claim 5, wherein one of said bearing and support means is provided both forward and rearward of said needle hole and on each side thereof.

7. The improvement in a sewing machine in accordance with claim 6, and said bearing and support means always being covered by said feedplate.

8. The improvement in a sewing machine in accordance with claim 6, said throatplate having a spaced pair of needle holes, and a pair of bearing and support means, one forward and one rearward on the side of each needle hole opposite from the other, and a pair of bearing and support means disposed between said needle holes, one being forward and the other rearward of said needle holes.

* * * * *

UNITED STATES PATENT AND TRADEMARK OFFICE

CERTIFICATE OF CORRECTION

PATENT NO. : 4,441,444

DATED : April 10, 1984

INVENTOR(S) : W. H. Jung

It is certified that error appears in the above-identified patent and that said Letters Patent is hereby corrected as shown below:

1. In a sewing machine having a throatplate with a needle hole and a feedplate disposed above said throatplate universally driven in accordance with a preprogrammed pattern and having an opening continuously exposing the needle hole, the improvement comprising an anti-friction [bearing and support] means comprising:

a plurality of openings in said throatplate in a spaced series around said needle hole; [and]

a plurality of bearing and support means each disposed in close fitting relationship in a different one of said openings so as to prevent translation movement of said bearing and support means, and extending outwardly therefrom engaging said feedplate from beneath to support same at a fixed distance above the throatplate and to provide a low friction connection beneath the throatplate and the feedplate;

said bearing and support means being of a better wear resistant material having a lower coefficient of friction than said throat and feedplates.

UNITED STATES PATENT AND TRADEMARK OFFICE

CERTIFICATE OF CORRECTION

PATENT NO. : 4,441,444

DATED : April 10, 1984

INVENTOR(S) : W. H. Jung

It is certified that error appears in the above-identified patent and that said Letters Patent is hereby corrected as shown below:

2. The [anti-friction] improvement in a sewing machine in accordance with claim 1, wherein said bearing and support means forming interfaces with said feedplate equal in area to only a small fraction of the interspace between said throat and feedplates .

Signed and Sealed this

Fifth Day of March 1985

[SEAL]

*Attest:*

DONALD J. QUIGG

*Attesting Officer* *Acting Commissioner of Patents and Trademarks*